United States Patent [19]

Hori et al.

[11] Patent Number: 5,033,437

[45] Date of Patent: Jul. 23, 1991

[54] METHOD OF CONTROLLING AIR-FUEL RATIO FOR USE IN INTERNAL COMBUSTION ENGINE AND APPARATUS OF CONTROLLING THE SAME

[75] Inventors: Toshio Hori; Takeshi Atago; Masami Nagano, all of Katsuta, Japan

[73] Assignee: Hitachi, Ltd., Tokyo, Japan

[21] Appl. No.: 402,787

[22] Filed: Sep. 5, 1989

[30] Foreign Application Priority Data

Sep. 5, 1988 [JP] Japan ..... 63-220307

[51] Int. Cl.[5] ..... F02D 41/14

[52] U.S. Cl. ..... 123/489

[58] Field of Search ..... 123/440, 489

[56] References Cited

U.S. PATENT DOCUMENTS 4,561,400 12/1985 Hattori ..... 123/440 X
4,726,344 2/1988 Ando et al. ..... 123/440

FOREIGN PATENT DOCUMENTS 106937 4/1989 Japan ..... 123/489
106938 4/1989 Japan ..... 123/489
106939 4/1989 Japan ..... 123/489
106941 4/1989 Japan ..... 123/489
2162662 2/1986 United Kingdom ..... 123/489

*Primary Examiner*—Tony M. Argenbright
*Attorney, Agent, or Firm*—Antonelli, Terry, Stout & Kraus

[57] ABSTRACT

A basic fuel injection pulse width value indicating an individual performance of an injector and an intake air flow amount value indicating an individual performance of an air flow sensor are prepared so as to memorize in plural memory areas in a store table, respectively. Deviations due to the basic fuel injection pulse width and deviations due to the intake air flow amount are memorized in the memory areas as learning values for controlling an air-fuel ratio, respectively. A corrected fuel injection pulse width is requested under the memorized learning values. An estimation learning is carried out at a first time learning. A first time learning value of the basic fuel injection pulse width is memorized in a whole area of the store table, and a first time learning value of the intake air flow amount is memorized in a corresponding area of the store table. By carrying out the learning on the air-fuel ratio control in accordance the estimation learning, the learning value absorbs the individual performance dispersion of the injector and the air flow sensor.

9 Claims, 8 Drawing Sheets

METHOD OF CONTROLLING AIR-FUEL RATIO FOR USE IN INTERNAL COMBUSTION ENGINE AND APPARATUS OF CONTROLLING THE SAME

BACKGROUND OF THE INVENTION

The present invention relates to a method of controlling an air-fuel ratio for use in an internal combustion engine and an apparatus for controlling the same and, more particularly to a method of controlling an air-fuel ratio for use in an internal combustion engine suitable for an electric spark ignition type gasoline internal combustion engine and an apparatus for controlling the same.

In a method of controlling the air-fuel ratio according to the present invention, a fuel injection amount being supplied into the internal combustion engine is corrected and thereby the air-fuel ratio in an automatic internal combustion engine control system is controlled or corrected.

The present invention relates to a method of controlling an air-fuel ratio for use, in an internal combustion engine and an apparatus for controlling the same, incorporating a plurality of sensors and an electronic control unit which receives signals from various sensors and which controls a fuel injection amount and an air-fuel ratio in the automatic internal combustion engine control system.

In a method of controlling air-fuel ratio for use in an internal combustion engine equipped with a fuel injection and control, system, an air-fuel ratio control method is employed for accurately and appropriately controlling an amount of fuel being supplied by the fuel injection system during various and diverse operational conditions of the internal combustion engine so as to provide good engine operational characteristics, and an air-fuel ratio control apparatus is operated in accordance the above stated air-fuel ratio control method.

A method of controlling air-fuel ratio for use in an electric spark ignition type gasoline internal combustion engine suitable for use in an automobile has a learning function for the air-fuel ratio and apparatus for controlling the same. In a method of controlling air-fuel ratio for use in an automobile, a deviation to a target value of an air-fuel ratio is divided at a predetermined rate in accordance with a parameter indicating an operational condition of the internal combustion engine, and each divided deviation is learned as a distinct element of an engine operational condition parameter.

In a conventional apparatus for controlling air-fuel ratio for use in an internal combustion engine, a fuel injection amount being supplied into the internal combustion engine is determined in accordance with a parameter indicating an operational condition of the internal combustion engine, and an air-fuel ratio is calculated in accordance with a physical amount of an exhaust gas.

The above stated conventional air-fuel ratio control technique in the field of the internal combustion engine will be explained in more detail as follows referring to FIG. 2.

An intake air flow amount $Q_a$ being taken into an electric spark ignition type gasoline internal combustion engine 7 for an automobile is detected with an air flow sensor 3, and a fuel injection amount is determined through an electronic control unit 15. A fuel injector 13 is driven and then fuel is injected into a combustion chamber of the gasoline internal combustion engine 7.

When exhaust gas having been burned in the combustion chamber passes at a position in which an oxygen concentration detecting sensor ($O_2$ sensor) 19 is provided at a midway portion of an exhaust pipe, and an actual air-fuel ratio is detected through $O_2$ sensor 19. The electronic control unit 15 adjusts the fuel injection amount in accordance with this detected signal from $O_2$ sensor 19, thereby an optimum air-fuel ratio for the internal combustion engine 7 may be obtained.

A fuel injection pulse width $T_i$ at this time is determined in the electronic control unit 15 in accordance with the following formulas.

$$T_i = T_p \cdot K_2 \cdot \alpha + T_s \quad (1)$$

$$T_p = K_1 \cdot Q_a / N \quad (2)$$

wherein $K_1$ is a constant, $Q_a$ is an intake air flow amount, N is an engine speed, $K_2$ is a correction coefficient according to an engine cooling water temperature etc., $\alpha$ is an air-fuel ratio correction coefficient, $T_s$ is a battery voltage correction part, and $T_p$ is a basic fuel injection pulse width.

A feed-back control for controlling the air-fuel ratio through $O_2$ sensor 19 in the internal combustion engine 7 is carried out by using the air-fuel ratio correction coefficient $\alpha$ shown in the formula (1).

The air-fuel ratio correction coefficient $\alpha$ moves so as to inject the fuel injection pulse width $T_i$ with a condition having a theoretical air-fuel ratio being a value of 14.7. When the theoretical air-fuel ratio is a value of 14.7, the air-fuel ratio correction coefficient $\alpha$ becomes a value of 1.0. When the air-fuel ratio resides at a rich side, the air-fuel ratio correction coefficient $\alpha$ is smaller than 1.0, and when the air-fuel ratio resides at a lean side, the air-fuel ratio correction coefficient $\alpha$ is larger than 1.0.

Herein, in case of the air-fuel ratio correction coefficient $\alpha = 1.0$ or during assembling the air flow sensor 3 or the fuel injector 13 etc. in which no learning for the air-fuel ratio control is carried out, the fuel injection amount being supplied into the internal combustion engine 7 varies due to an individual performance characteristic of the air flow sensor 3, or the fuel injector 13 etc.

Each individual performance dispersion of the apparatus comprising a fuel injection and control system such as the air flow sensor 3 and the fuel injector 13 etc. may absorb momentarily through the change of such an air-fuel ratio correction coefficient $\alpha$ value in accordance with the feed-back control for the air-fuel ratio in the internal combustion engine 7.

However, when the engine is operating in a low temperature period etc. during an engine operation in which $O_2$ sensor 19 operates in an unavailable area, or in case the feed-back control for the air-fuel ratio cannot follow conditions due to rapid changes in the operational condition of the internal combustion engine 7, then it is impossible to absorb such individual performance dispersion in the operation of the fuel injection and control apparatuses, such as the air flow sensor 3, the fuel injector 13 etc.

In the automatic control of the air-fuel ratio in the internal combustion engine 7, due to various causes, it is very difficult to have no occurrence of errors, however an actual damage being suffered by those errors may be eliminated through the control or correction of those errors.

Now, the maximum main factors in the errors with regard to the automatic control of the air-fuel ratio in the internal combustion engine 7 are an error in detection through the individual performance dispersion of the air flow sensor 3 and an error in the fuel injection amount through the individual performance dispersion of the fuel injector 13.

For example, the tolerance of the air flow sensor is about ±6% and the tolerance of the fuel injector is from about ±7.1% to about ±4.5%. The total tolerance is from about ±13.1% to about ±10.5%. Therefore, it is impossible to neglect the individual performance dispersions by the air flow sensor and the fuel injector.

Namely, in the conventional automatic air-fuel ratio control technique, there are problems that when the extent of deviation in the intake air flow amount $Q_a$ and the extent of deviation in the fuel injection amount are changed in accordance with the value of the engine operational condition parameter, no high accuracy of the air-fuel ratio control or correction is obtained.

Further, in the conventional automatic air-fuel ratio control technique, there are no considerations given to a method of the learning for air-fuel ratio control or correction in the electronic control unit and also ways to achieve an early convergence for the air-fuel ratio control or correction.

A conventional air-fuel ratio control technique for use in an internal combustion engine is disclosed, for example, in U.S. Pat. No. 4,726,344, in which an optimum air-fuel ratio in the internal combustion engine is determined in dependence upon renewal of a plurality of learning values related to a plurality of load regions of the internal combustion engine. This air-fuel ratio control technique is arranged to conduct simultaneous learning of the learning values at a frequency in accordance with a lapse of time and to conduct selective learning of the learning values in accordance with a change of the load acting on the internal combustion engine.

SUMMARY OF THE INVENTION

An object of the present invention is to provide a method of controlling an air-fuel ratio for use in internal combustion engine and an apparatus for controlling the same wherein control or correction for an air-fuel ratio through learning with respect to a deviation to a target air-fuel ratio can be carried out accurately.

Another object of the present invention is to provide a method of controlling an air-fuel ratio for use in an internal combustion engine and an apparatus for controlling the same wherein a target air-fuel ratio can be obtained accurately through absorbing a deviation of an actual air-fuel ratio to a target air-fuel ratio which is caused by an individual performance dispersion of various kinds of apparatuses comprising an automatic fuel injection and control system.

A further object of the present invention is to provide a method of controlling an air-fuel ratio for use in an internal combustion engine and an apparatus for controlling the same wherein, after start of learning for an air-fuel ratio control or correction, a deviation to a target air-fuel ratio can be controlled or corrected early.

A further object of the present invention is to provide a method of controlling an air-fuel ratio for use in an internal combustion engine and an apparatus for controlling the same wherein learning for air-fuel ratio control or correction can be converged early through estimating and memorizing a learning value for an air-fuel ratio control or correction.

A further object of the present invention is to provide a method of controlling an air-fuel ratio for use in an internal combustion engine and an apparatus for controlling the same wherein a first time learning for an air-fuel ratio control or correction can be practiced with an estimation and a successive following time learning can be realized early using a learning value obtained by this first time learning.

According to the present invention, a method of controlling an air-fuel ratio for use in an internal combustion engine has steps in which a fuel injection amount to be supplied into an internal combustion engine is determined in accordance with parameters indicating an operational condition of the internal combustion engine, an air-fuel ratio is calculated in accordance with a physical amount of an exhaust gas, a deviation to a target value of the air-fuel ratio is divided at a predetermined rate in accordance with the parameters indicating the operational condition of the internal combustion engine, and a respective divided deviation is learned as a respective distinct element for the parameters indicating the operational condition of the internal combustion engine.

The respective divided deviation is memorized in one of a plurality of memory areas, a calculation for calculating the deviation from the target value of the air-fuel ratio and a division for dividing the deviation in accordance with the parameters indicating the operational condition of the internal combustion engine are carried out repeatedly, and a value being memorized in one of the plurality of memory areas is updated at every repeated time by a learning using a value of the divided deviation.

According to the present invention, an apparatus for controlling air-fuel ratio for use in an internal combustion engine has an execution means for calculating a fuel injection amount in accordance with parameters indicating an operational condition of an internal combustion engine, an execution means for calculating an air-fuel ratio in accordance with a physical amount of an exhaust gas, a comparison execution means for calculating a deviation by comparing a target value of an air-fuel ratio to the calculated value of the air-fuel ratio obtained by the air-fuel ratio execution means, an execution means for dividing the calculated deviation obtained by the comparison execution means in accordance with parameters indicating the operational condition of the internal combustion engine, and an execution means for learning the calculated divided deviation by the comparison execution means as a respective distinct element and for correcting the air-fuel ratio.

The air-fuel ratio control apparatus has a memory means for memorizing the calculated divided deviation obtained by the comparison execution means and having a respective plurality of memory areas for the parameter indicating the operational condition of the internal combustion engine, a multiply means for dividing the calculated deviation value of the air-fuel ratio obtained by the air-fuel ratio execution means by a predetermined function, and a learning execution means for updating a value being memorized in the respective plurality memory areas in accordance with the deviation value divided by the multiply means.

When the above stated method or apparatus of controlling an air-fuel ratio for use in an internal combustion engine is adopted, after the deviation to the target air-fuel ratio is divided at a predetermined rate in accordance with the engine operational condition parameter, then such a divided deviation to the target air-fuel ratio is memorized respectively with a distinction in accordance with the engine operational condition parameter of that time.

Since the memorized value of the divided deviation to the target air-fuel ratio is related to the fuel injection amount through the map search of a suitable value in accordance with the engine occasionally operational condition parameter, the fuel injection amount and the air-fuel ratio can be controlled or corrected accurately.

Further, since the deviation to the target air-fuel ratio in another engine operational condition is estimated and memorized from the deviation to the target air-fuel ratio in one engine operational condition, then a request time for memorizing the dimension of an actual deviation can be shortened, and after a start of the learning the deviation to the target air-fuel ratio can be controlled or corrected early.

In the present invention, an area for memorizing a correction value for an individual performance dispersion of the automatic engine control system is provided on the electronic control unit. The correction value for the individual performance dispersion is memorized in accordance with the calculated new air-fuel ratio correction coefficient $\alpha$ value obtained by the feed-back control, then the fuel injection amount and the air-fuel ratio is adjusted and learned in accordance with this correction value.

So as to carry out the learning on the air-fuel ratio control, it is necessary to judge whether or not the air-fuel ratio correction coefficient $\alpha$ value through the feed-back control is reliable. Since the value due to the individual performance dispersion differs from the operational area of the engine, it is necessary that the engine operational condition exists in a specific area so as to be stable for the air-fuel ratio correction coefficient $\alpha$ value.

Accordingly, as a condition for starting the learning of the air-fuel ratio control, for example, two independent parameters indicating the engine operational condition, namely the value of the engine speed N and the value of the basic fuel injection pulse width $T_p$, have to be involved in one of the lattices shown in FIG. 4 as the feed-back control in order for the air-fuel ratio correction coefficient $\alpha$ to become stable.

According to the method and the apparatus of the present invention, the deviation, of the actual air-fuel ratio which causes the individual performance dispersions of various kinds of apparatuses comprising a fuel injection and control system for a fuel injection type gasoline internal combustion engine, is absorbed, so that the target air-fuel ratio can be obtained accurately. Further since the air-fuel ratio controlling apparatus structure is made to estimate and memorize the learning value, then the learning in the air-fuel ratio control or correction can be converged early.

DESCRIPTION OF THE INVENTION

One embodiment of a method of controlling an air-fuel ratio for use in an internal combustion engine according to the present invention will be explained as follows. This embodiment of an air-fuel ratio control or correction method is practiced in accordance with one embodiment of a fuel injection amount control or an air-fuel ratio control apparatus for use in an internal combustion engine according to the present invention.

In an air-fuel ratio control method for use in an electric spark ignition type gasoline internal combustion engine 7 suitable for an automobile, there are two main factors for a deviation to a target air-fuel ratio as above mentioned. Namely, the two main factors are an error in a fuel injection amount and an error in an intake air flow amount $Q_a$.

The error in the fuel injection amount is caused by a fuel injection amount error through an individual performance dispersion of a fuel injector 13. The error in the intake air flow amount $Q_a$ is caused by an air flow amount detection error through an individual performance dispersion of a hot wire type air flow sensor 3.

Figure 3:
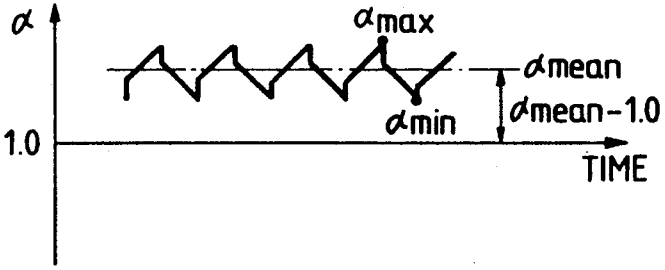
FIG. 3 is an explanatory graph showing a drift of an air-fuel ratio correction coefficient $\alpha$ in a fuel injection and control system.
Figure 4:
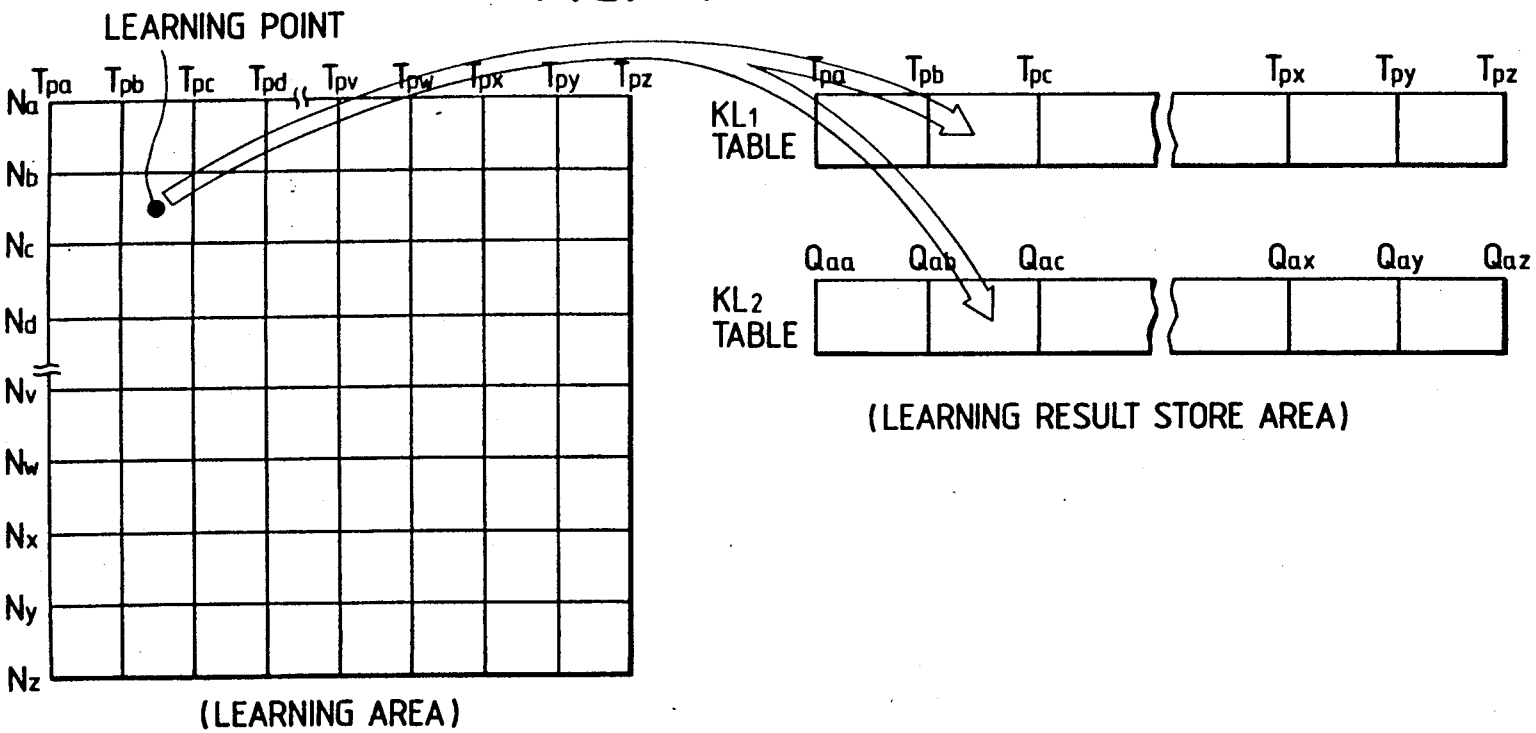
FIG. 4 is an explanatory graph showing a lattice as a learning area in one engine operational condition used for in judgment of the learning realization of the air-fuel ratio control or correction and a learning result store area.

The value of the air-fuel ratio correction coefficient $\alpha$ in the feed-back control for controlling the air-fuel ratio may drift as shown in FIG. 3. In FIG. 3, when the theoretical air-fuel ratio is a value of 14.7 (a target value), the air-fuel ratio correction coefficient $\alpha$ is defined as a value of 1.0 (a target value).

When the above stated stability judgment for the engine operational condition is satisfied, the mean value $\alpha_{mean}$ of the air-fuel ratio correction coefficient is requested in accordance with the maximum value $\alpha_{max}$ of the air-fuel ratio correction coefficient and the minimum value $\alpha_{min}$ of the air-fuel ratio correction coefficient, namely the mean value $\alpha_{mean}$ is request in accordance with $(\alpha_{max}+\alpha_{min})/2$. The present time learning values $kl_{1(n)}$ and $kl_{2(n)}$ are requested with the following formulas in accordance with this mean value $\alpha_{mean}$ of the air-fuel ratio correction coefficient.

$$\delta_1=(\alpha_{mean}-1.0)\cdot\beta \quad (3)$$

$$\delta_2=(\alpha_{mean}-1.0)-\delta_1 \quad (4)$$

$$kl_{1(n)}=kl_{1(n-1)}+\delta_1\cdot\gamma_1 \quad (5)$$

$$kl_{2(n)}=kl_{2(n=1)}+\delta_2\cdot\gamma_2 \quad (6)$$

In the formula (3), $\delta_1$ is a predetermined rate part by the deviation from the mean value $\alpha_{mean}$ of the air-fuel ratio correction coefficient to 1.0. $\delta_2$ is a remainder in which $\delta_1$ is subtracted from the deviation from the mean value $\alpha_{mean}$ of the air-fuel ratio correction coefficient to 1.0.

Besides, one present time learning value $kl_{1(n)}$ comprises the value multiplying $\delta_1$ by a predetermined weighted coefficient $\gamma_1$ and an addition of the previous time learning value $kl_{1(n-1)}$. The other present time learning value $kl_{2(n)}$ comprises the value multiplying $\delta_2$ by a predetermined weighted coefficient $\gamma_2$ and an addition of the previous time learning value $kl_{2(n-1)}$.

When the predetermined rate part $\beta$ is 50%, the value of $\delta_1$ has the same value of $\delta_2$. When the predetermined rate part $\beta$ is 75%, the value of $\delta_1$ has three times value that of $\delta_2$. According to the value of the predetermined rate part $\beta$, the value $\delta_1$ and the value $\delta_2$ are divided at a predetermined rate respectively.

Figure 1:
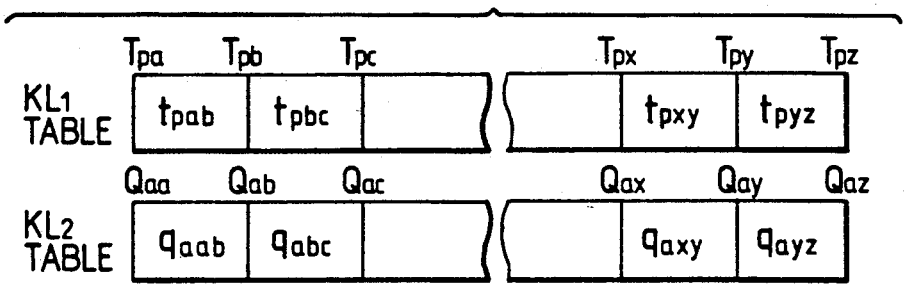
FIG. 1 is an explanatory block diagram showing a $KL_1$ store table for memorizing a value $kl_1$ and a $KL_2$ store table for a memorizing a value $kl_2$ for a learning value of one embodiment of a method of controlling an air-fuel ratio for use in an internal combustion engine or an apparatus of controlling the same according to the present invention.
Figure 2:
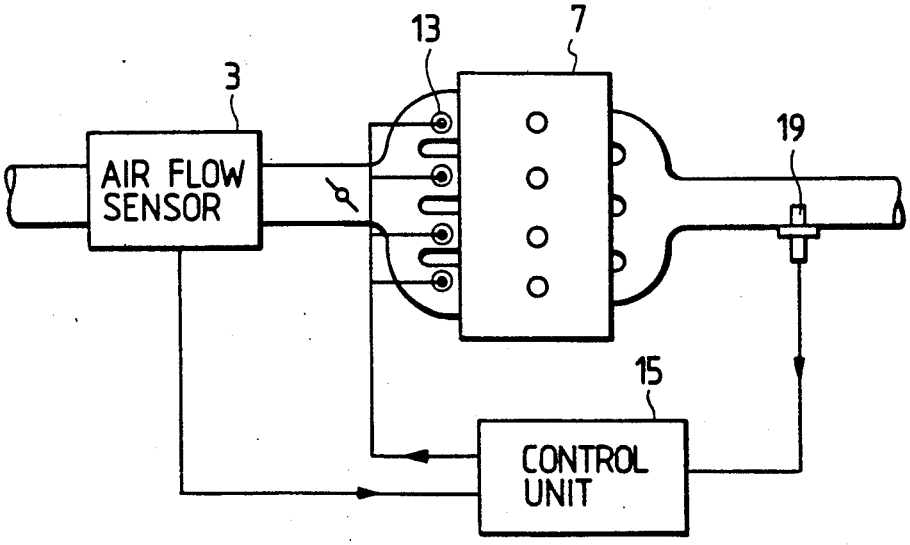
FIG. 2 is an outline explanatory view showing a control system of controlling an air-fuel ratio for use in an internal combustion engine of one embodiment of a method of controlling an air-fuel ratio for use in an internal combustion engine or an apparatus of controlling the same according to the present invention.

In one embodiment of the present invention, a plurality of memory areas $t_{pab}$-$t_{pyz}$ are provided on a $KL_1$ store table, and a plurality of memory areas $q_{aab}$-$q_{ayz}$ are provided on a $KL_2$ store table as shown in FIG. 1.

In the $KL_1$ store table, the basic fuel injection pulse width $T_p$ values indicating the individual performance of the fuel injector 4 are prepared so as to memorize in plural such as $T_{pa}$-$T_{pz}$. $T_p$ value is a value of a basic fuel injection pulse width. In the $KL_2$ store table, the intake air flow amount $Q_a$ values indicating the individual performance of the air flow sensor 3 are prepared so as to memorize in plural such as $Q_{aa}$-$Q_{az}$. $Q_a$ value is a value of an intake air flow amount.

Then, the deviations to the target air-fuel ratio under one operational condition of the internal combustion engine 7 are divided to the deviations due to the basic fuel injection pulse width $T_p$ and the deviations due to the intake air flow amount $Q_a$ in accordance with the above mentioned formulas (3)-(6).

According to an occasionally operational condition of the internal combustion engine 7, the deviations due to the basic fuel injection pulse width $T_p$ are memorized in the memory areas of the $KL_1$ store table as a learning value $kl_1$ comprising $t_{pab}$-$t_{pyz}$, and the deviations due to the intake air flow amount $Q_a$ are memorized in the memory areas of the $KL_2$ store table as a learning value $kl_2$ comprising $q_{aab}$-$q_{ayz}$, respectively as shown in FIG. 1.

The values and numbers of the division points for the plural basic fuel injection pulse width values $T_{pa}$-$T_{pz}$ in the $KL_1$ store table and the division points for the plural intake air flow amount values $Q_{aa}$-$Q_{az}$ in the $KL_2$ store table are set with a following method.

First of all, the distribution of the individual performance dispersions of the fuel injector 13 is indicated on an axis of the basic fuel injection pulse width $T_p$ of the graph and the distribution of the individual performance dispersions of the air flow sensor 3 is indicated on an axis of the intake air flow amount $Q_a$ of the graph, respectively.

The values and numbers of the division points of the plural basic fuel injection pulse width values $T_{pa}$-$T_{pz}$ in the $KL_1$ store table and the plural intake air flow amount values $Q_{aa}$-$Q_{az}$ in the $KL_2$ store table are set voluntarily so as to make a sufficient correction therefor in accordance with the distributions on each of the basic fuel injection pulse width $T_p$ axis and the intake air flow amount $Q_a$ axis of the individual performance dispersions. This settlement for the values and numbers of the division points may be practised according to the investigation on design.

The corrected fuel injection pulse width $T_{io}$ is requested through next calculation formulas under the base of thus memorized values $kl_1$ and $kl_2$ as learning values.

$$T_{io}=T_{po}\cdot K_2\cdot\alpha\cdot kl_1+T_s \quad (7)$$

$$T_{po}=K_1\cdot Q_a/N\cdot kl_2 \quad (8)$$

The learning value $kl_2$ is a correction value due to the intake air flow amount $Q_a$ and it is multiplied by the intake air flow amount $Q_a$ during the calculation of the corrected basic fuel injection pulse width $T_{po}$. The learning value $kl_1$ is multiplied by the corrected basic fuel injection pulse width $T_{po}$ during the calculation of the corrected fuel injection pulse width $T_{io}$ in the same way.

Herein, the learning values $kl_1$ and $kl_2$ are requested respectively from the corrected basic fuel injection pulse width $T_{po}$ value and the intake air flow amount $Q_a$ value of the engine operational condition of that time through the map search on the $KL_1$ store table and the map search on the $KL_2$ store table shown in FIG. 1.

Herein, both initial values in the learning values $kl_1$ and $kl_2$ are values of 1.0, and the individual performance dispersion of each apparatus for the automatic engine control system is estimated during the first time learning.

Namely, from the tendency of the dispersion in the individual performances of the air flow sensor 3 and the fuel injector 13, then the divided deviations $kl_{11}$ and $kl_{21}$ at the first time learning are memorized or stored in the respective areas excepting for corresponding areas in which the learning have been realized for the learning values $kl_1$ and $kl_2$ in the $KL_1$ store table and the $KL_2$ store table or in the whole area all over.

The ranges and values for memorizing the divided deviations may set voluntarily from the dispersion tendency of the individual performances of the air flow sensor 3 and the fuel injector 13. For example, the dispersion tendency at the corrected basic fuel injection pulse width $T_{po}$ axis standard is dominant among the dispersions and when the dispersion tendency is a parallel movement from the standard, then the first time learning value $kl_{11}$ is memorized or stored all over in a whole area of the $KL_1$ store table.

Further, during the first time learning on the air-fuel ratio control, the function $\gamma_1$ in the formula (5) and the function $\gamma_2$ in the formula (6) may be provided separately according to the probability about the estimation, and the learning values of $kl_1$ and $kl_2$ may be set voluntarily. Since these functions $\gamma_1$ and $\gamma_2$ have a respectively very large convergency, even in case of the voluntary settlement of the learning values of $kl_1$ and $kl_2$ may converge immediately and determinate statically.

In this embodiment of the present invention, the function $\gamma_{11}$ at the first time learning for the divided deviation due to the corrected basic fuel injection pulse width $T_{po}$ in the $KL_1$ store table is differed from each value of the function $\gamma_1$ in the successive following times, namely the function $\gamma_{11}$ at the first time learning is set larger than the value of the function $\gamma_1$ in any successive following time learning.

And also the function $\gamma_{21}$ at the first time learning for the divided deviation due to the intake air flow amount $Q_a$ in the $KL_2$ store table is differed from each value of the function $\gamma_2$ in the successive following times, namely the function $\gamma_{21}$ at the first time learning is set larger than the value of the function $\gamma_2$ in any successive following time learning.

At the first time learning, the estimation learning is carried out using the larger value of the function $\gamma_{11}$ or $\gamma_{21}$. The renewal of the value of the first time learning $kl_{11}$ of $kl_{21}$ is carried out using the formula $\delta_1 \cdot \gamma_{11}$ or the formula $\delta_2 \cdot \gamma_{21}$. The first time learning value $kl_{11}$ is memorized in a whole area of the $KL_1$ store table. The first time learning value $kl_{21}$ is memorized in a corresponding area of the $KL_2$ store table. After that, in the ordinary time learning or in any successive following time learning, the smaller value of the function $\gamma_1$ or $\gamma_2$ is used respectively.

As to the intake air flow amount $Q_a$ axis standard, it is possible to practise with the similar calculating operation shown in case of the corrected basic fuel injection pulse width $T_{po}$ standard. It is possible to set to memorize respectively the first time learning value $kl_{11}$ and the first time learning value $kl_{21}$ on both the $KL_1$ store table and the $KL_2$ store table.

Further, when the individual performance dispersion tendency has no characteristic over a whole area of the corrected basic fuel injection pulse width $T_{po}$ axis or the intake air flow amount $Q_a$ axis, it is possible to memorize at only a limited memory area in the $KL_1$ store table or the $KL_2$ store table respectively, for example it may memorize in an adjacent memory area against corresponding memory area in which the first time learning has been realized.

By carrying out the learning on the air-fuel ratio control in accordance with the above stated estimation, a time for reaching a value, in which $kl_1$ learning value or $kl_2$ learning value absorbs accurately the individual performance dispersion, can be shortened, accordingly the target air-fuel ratio can be obtained early according to this embodiment of the present invention.

Figure 5:
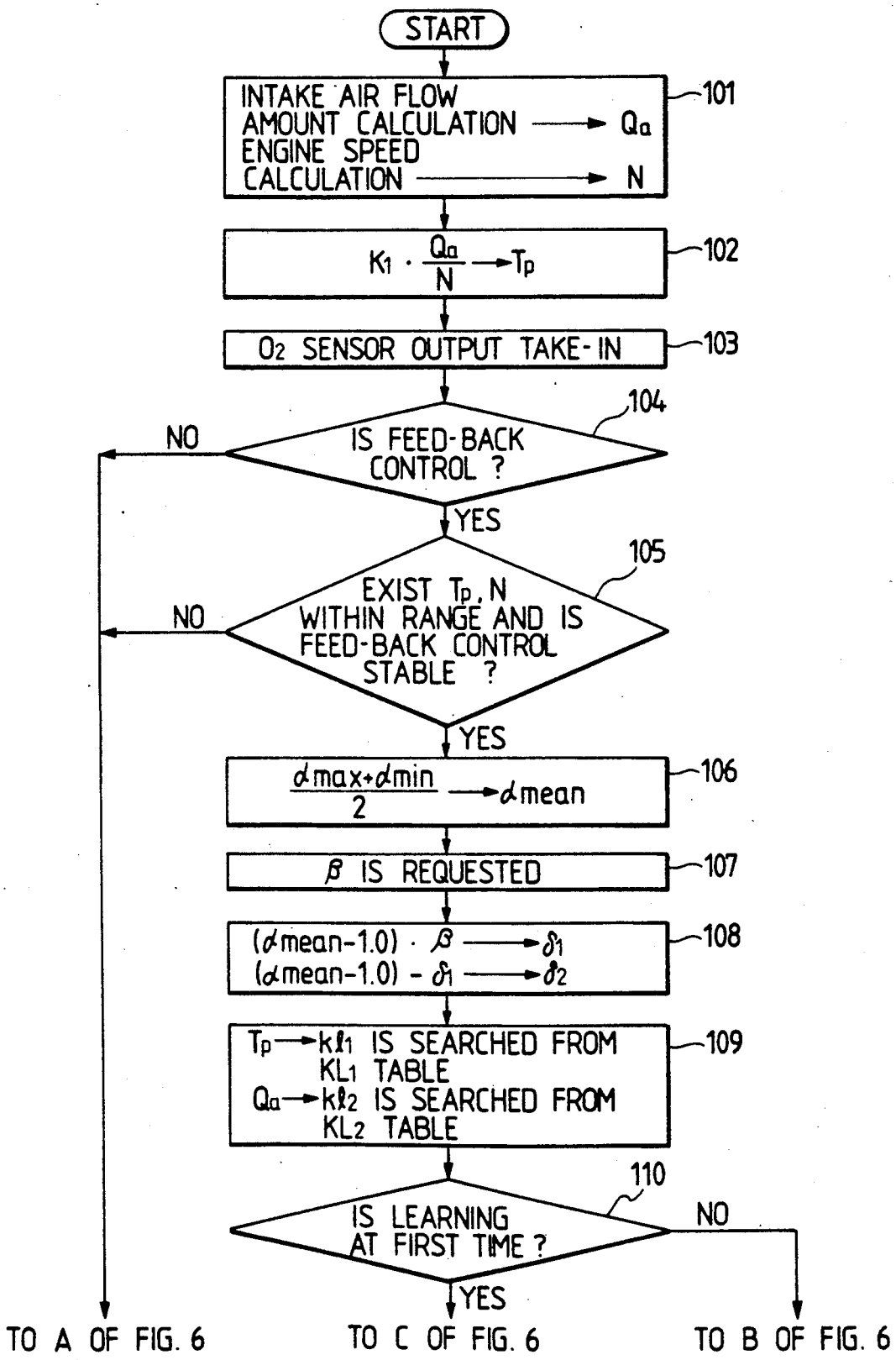
FIG. 5 and FIG. 6 are flow-charts showing control flow-charts for controlling an air-fuel ratio control or correction.
Figure 6:
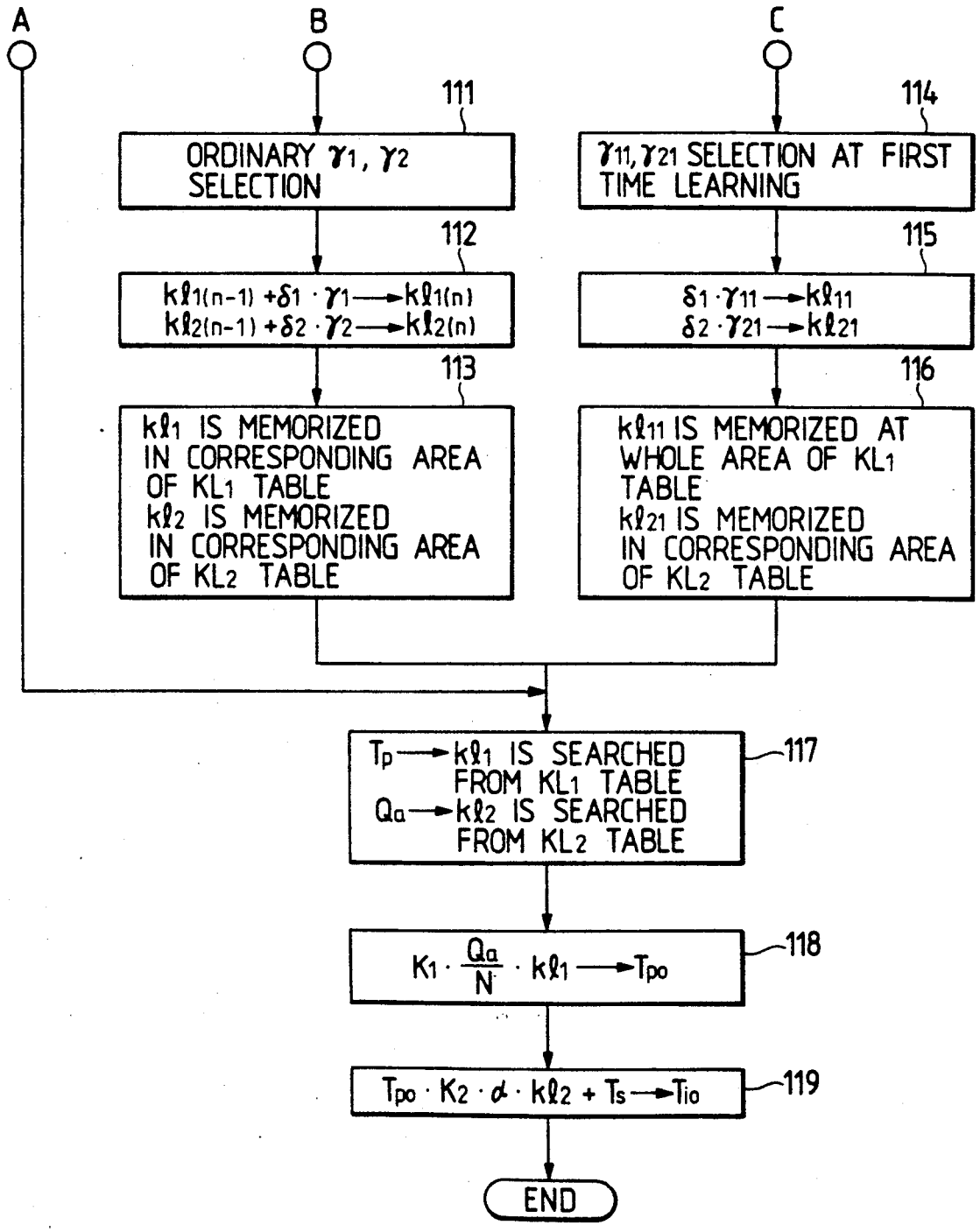

Flow-charts for the above control method of controlling the air-fuel ratio control or correction are shown in FIG. 5 and FIG. 6.

In a control step 101 of a flow-chart shown in FIG. 5, the intake air flow amount $Q_a$ is calculated through detection of the air flow sensor 3 and also the engine speed N is calculated through the detection of an engine speed detecting sensor. In a control step 102 of FIG. 5, the basic fuel injection pulse width $T_p$ is calculated in the electronic control unit 15 in accordance with the formula (2).

In a control step 103 of FIG. 5, an output of $O_2$ sensor 19 is taken in, in a control step 104 of FIG. 5 it is judged whether or not under the feed-back control period of the automatic engine control system. In a control step 105 of FIG. 5, it is judged whether or not both the basic fuel injection pulse width $T_p$ and the engine speed N exist in a predetermined range and also whether or not the feed-back control is stable.

In a control step 106 of FIG. 5, the mean value $\alpha_{mean}$ of the air-fuel ratio correction coefficient is calculated in the electronic control unit 15 in accordance with the formula $(\alpha_{max}+\alpha_{min})/2$. In a control step 107 of FIG. 5, the predetermined part $\beta$ of the deviation to the value of $(\alpha_{mean}-1.0)$ is requested in the electronic control unit 15. In a control step 108 of FIG. 5, the values $\delta_1$ and $\delta_2$ are calculated respectively in accordance with the formulas (3) and (4).

In a control step 109 of FIG. 5, with regard to the basic fuel injection pulse width $T_p$, the value $kl_1$ is searched from using a map of the $KL_1$ store table, and with regard to the intake air flow amount $Q_a$, the learning value $kl_2$ is searched from using a map of the $KL_2$ store table, respectively. In a control step 110 of FIG. 5, it is judged whether or not the learning is a first time.

In a control step 111 of a flow-chart shown in FIG. 6, the ordinary function values $\gamma_1$ and $\gamma_2$ are selected. The ordinary function values $\gamma_1$ and $\gamma_2$ in the present invention express that the values are not at the first time but the values of on and after the second time or the values in subsequent times after the first time.

In a control step 112 of FIG. 6, the present time value $kl_{1(n)}$ is calculated in accordance with the formula (5) and the present time value $kl_{2(n)}$ is calculated in accordance with the formula (6), respectively. In a control step 113 of FIG. 6, the learning value $kl_1$ is memorized in the corresponding area of the $KL_1$ store table and the learning value $kl_2$ is memorized in the corresponding area of the $KL_2$ store table, respectively.

In a control step 114 of FIG. 6, the function values $\gamma_{11}$ and $\gamma_{21}$ of the learning at the first time are selected respectively. In a control step 115 of FIG. 6, the first time learning value $kl_{11}$ is calculated using the function value $\gamma_{11}$ in accordance with the formula shown in the control step 115 and the first time learning value $kl_{21}$ is calculated using the function value $\gamma_{21}$ in accordance with the formula shown in the control step 115, respectively.

In a control step 116 of FIG. 6, the first time learning value $kl_{11}$ is memorized in the whole memory area of the $KL_1$ store table and the first time learning value $kl_{21}$ is memorized in the corresponding memory area of the $KL_2$ store table, respectively. The first time learning value $kl_{11}$ may be memorized in the plurality of memory areas.

In a control step 117 of FIG. 6, with regard to the corrected basic fuel injection pulse width $T_{po}$ is searched from the map of the $KL_1$ store table, and with regard to the intake air flow amount $Q_a$ is searched from the map of the $KL_2$ store table, respectively.

In a control step 118 of FIG. 6, the corrected basic fuel injection pulse width $T_{po}$ is calculated in accordance with the formula (8). In a control step 119 of FIG. 6, the corrected fuel injection pulse width $T_{io}$ is calculated in accordance with the formula (7).

Further, the various examination results obtained in accordance with this embodiment of the present invention will be explained referring to from FIG. 7 to FIG. 10.

Figure 7:
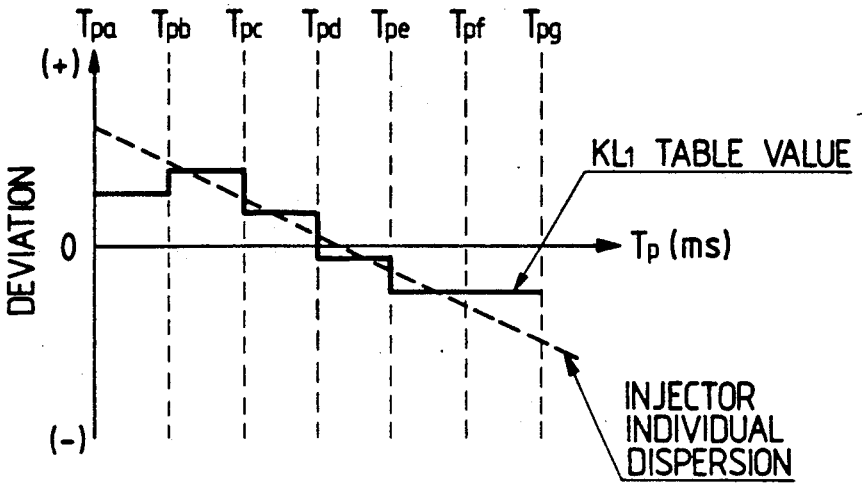
FIG. 7 is a graph showing deviation values in a $KL_1$ store table according to a fuel injector individual performance dispersion after a running of a 10 modes running test.

FIG. 7 shows the divided deviation learning values $kl_1$ in the $KL_1$ store table after the running at the 10 modes running test at a step-wise solid line. In addition, the individual performance dispersion of the fuel injection characteristic of the fuel injector 13 which is given intentionally is shown as a linear broken line.

The divided deviation learning values $kl_1$ in the $KL_1$ store table with the respect to the fuel injector 13 are shown with various levels in the respective memory areas between from $T_{pa}$-$T_{pb}$ to $T_{pf}$-$T_{pg}$. Besides, the intentionally individual performance of the fuel injector 13 is shown in a linear broken line.

The $kl_1$ learning value distribution agrees to a great deal with the deviation of the individual performance dispersion of the fuel injector 13, therefore it will be understood that the deviation to the target air-fuel ratio against the fuel injection pulse width $T_p$ value is absorbed. Besides, the reason why both values at both end portions in the fuel injection pulse width $T_p$ axis disagree from is that the corresponding memory areas do not have many memory areas in the 10 modes running test condition.

Figure 8:
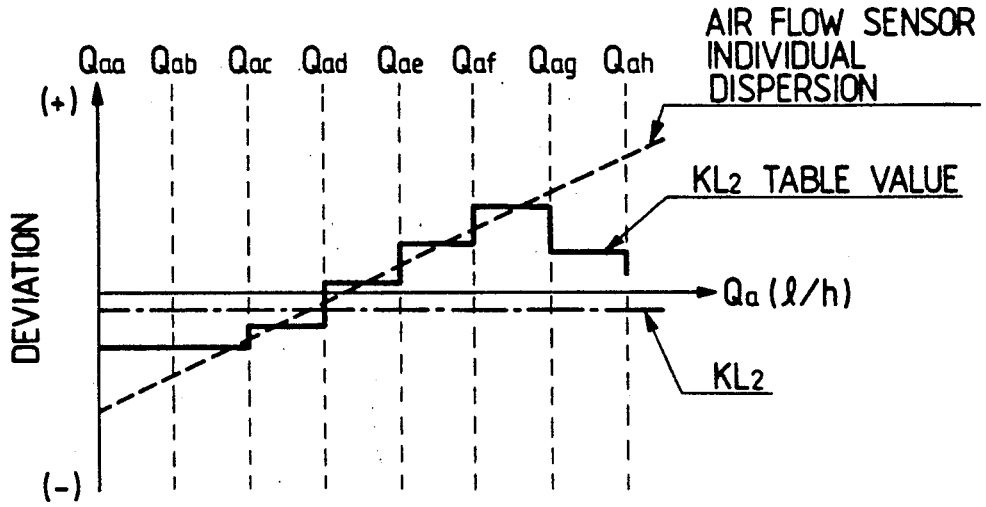
FIG. 8 is a graph showing deviation values in a $KL_2$ store table according to an individual performance dispersion of an air flow sensor after a running of a 10 modes running test.

The divided deviation learning values $kl_2$ in the $KL_2$ store table under the same condition will be shown in FIG. 8 at a step-wise solid line. In addition, there is shown that the individual performance dispersion of the detection characteristic for the intake air flow amount $Q_a$ by the air flow sensor 3 which is given intentionally and shown at a linear broken line, and in this case the $kl_2$ learning value as shown at a linear one dot chain line in which the store place (memory area) for the value $kl_2$ is only one place.

The divided deviation learning values $kl_2$ in the $KL_2$ store table with the respect to the air flow sensor 3 are shown with various levels in the respective memory area between from $Q_{aa}$-$Q_{ab}$ to $Q_{ag}$-$Q_{ah}$. Besides, the intentionally individual performance of the air flow sensor 3 is shown at a linear broken line.

When each learning value $kl_2$ is memorized in the $KL_2$ store table according to the embodiment of the present invention, this value agrees to a great deal the individual performance dispersion of the air flow sensor 3, and it will be comprehended that the deviation to the target air-fuel ratio against the intake air flow amount $Q_a$ value is absorbed.

However, when the case that the store place (memory area) for the value $kl_2$ is one place, then such a value $kl_2$ obtains a value in the most frequent place under the engine operational condition, and the deviation to the individual performance dispersion of the air-flow sensor 3 causes at the rest areas.

According to this embodiment of the present invention, as shown in FIG. 7, the deviation factor of the air-fuel ratio due to the individual performance dispersion of the fuel injector 13 is can be absorbed. Further, as shown in FIG. 8, the deviation factor of the air-fuel ratio due to the measurement value dispersion by the air flow sensor 3 also can be absorbed. As a result, the target air-fuel ratio according to this embodiment of the present invention can be obtained accurately.

Figure 9:
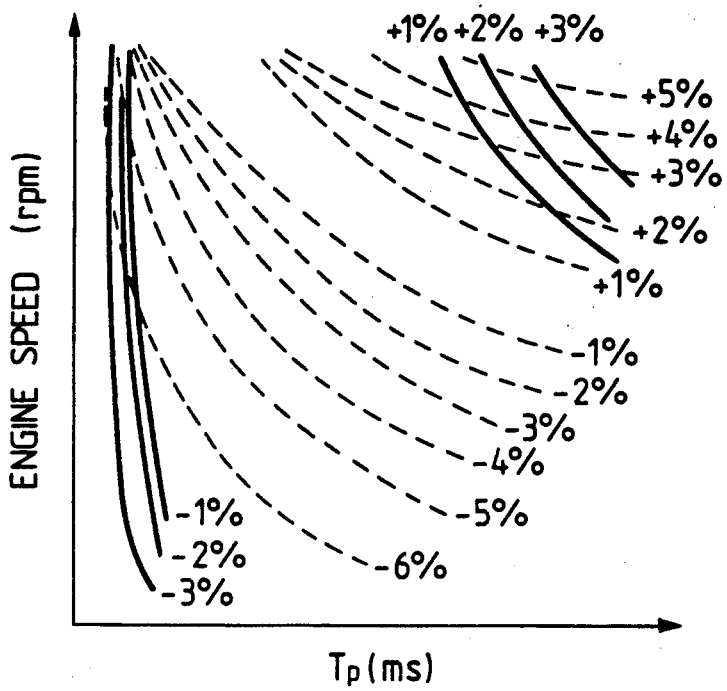
FIG. 9 is a graph showing distributions according to one embodiment of the present invention and the conventional technique, in which after a running of a 10 modes running test both distributions are requested respectively from when a deviation to a target air-fuel ratio is set as an air-fuel ratio correction coefficient $\alpha=1.0$.

FIG. 9 shows the various distributions in which the deviation to the target air-fuel ratio at a whole engine operational area during the above stated condition is set as the air-fuel ratio correction coefficient $\alpha=1.0$. The vertical axis in the graph depicted in FIG. 9 shows the engine speed N (unit: rpm), and the cross axis shows the fuel injection time (fuel injection pulse width) $T_p$ (unit: ms). A respective curve line depicted at the coordinate face in FIG. 9 is an isanomal curve line respectively.

In FIG. 9, each broken curve line shows respectively the case, in which the store place (memory area) for the $kl_2$ value in the $KL_2$ store table is only one store place. Besides, in FIG. 9, each solid curve line shows respectively the case of the embodiment according to the present invention, in which the store places (memory areas) for the $kl_2$ learning value in the $KL_2$ store table are in plural from $q_{aab}$ to $q_{ayz}$ as shown in FIG. 1.

The deviation to the target air-fuel ratio according to the conventional technique in which the deviation to the target air-fuel ratio causes at a wide range shown in the broken curve lines in FIG. 9, therefore the target air-fuel ratio is obtained with a narrow range. Besides the deviation to the target air-fuel ratio according to this embodiment of the present invention in which the deviation to the target air-fuel ratio causes at a narrow range shown in the solid curve lines in FIG. 9. Therefore, in this embodiment according to the present invention the target air-fuel ratio is obtained with a wide range shown in the solid curve lines in FIG. 9.

Figure 10:
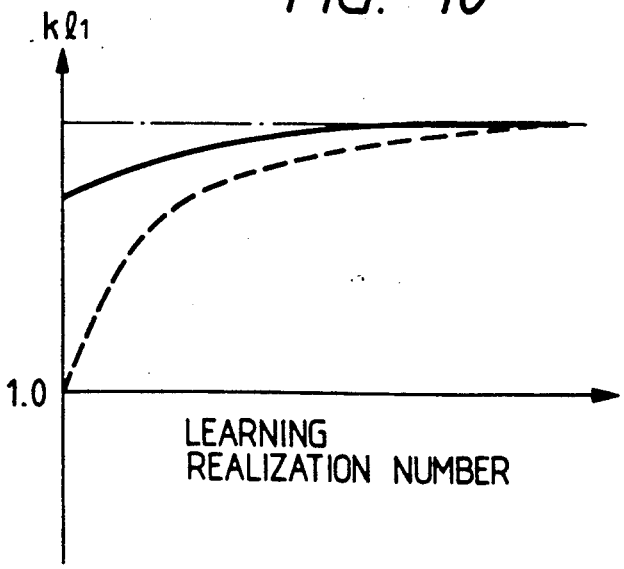
FIG. 10 is a graph showing a processing graph in which one $kl_1$ value in a $KL_1$ store table is made to change in accordance with a realization number for a learning in an air-fuel ratio control or correction.

FIG. 10 shows a processing graph in which one learning value $kl_1$ in the $KL_1$ store table is made to change by the realization numbers of the learning. The solid curve line in FIG. 10 shows in which the first time estimation learning is practised according to this embodiment of the present invention, besides the broken curve line shows in which no first time estimation learning is practised. The one-dot chain linear line shows a value in which the learning value $kl_1$ must converge.

At the first time learning, the estimation learning is carried out using the value of the function $\gamma_{11}$ or $\gamma_{21}$, each of value of the function $\gamma_{11}$ or $\gamma_{21}$ is set larger than the value of the function $\gamma_1$ or $\gamma_2$.

When the first time estimation learning is practised, the first time $kl_{11}$ learning value which has been practised another memory area is reflected, and in advance the learning on the air-fuel ratio control can start from an approximate value with the convergency value. According to this reason, the convergency value is gotten rid of through small realization numbers of the learning, therefore an early learning convergency can be obtained, because of the practice of the first time estimation learning as shown in the embodiment of the present invention.

Besides, as the detection means for detecting the intake air flow amount $Q_a$, there is a control system by the intake pipe pressure and the engine speed N, or a control system by the throttle valve opening degree $\theta_{th}$ and the engine speed N, etc. The control method and the control apparatus of controlling the air-fuel ratio in the present invention may adopt in any one of these above stated control systems.

One embodiment of an apparatus of controlling an air-fuel ratio for use in an internal combustion engine according to the present invention will be explained in detail as follows referring to FIG. 11 and FIG. 12.

Figure 11:
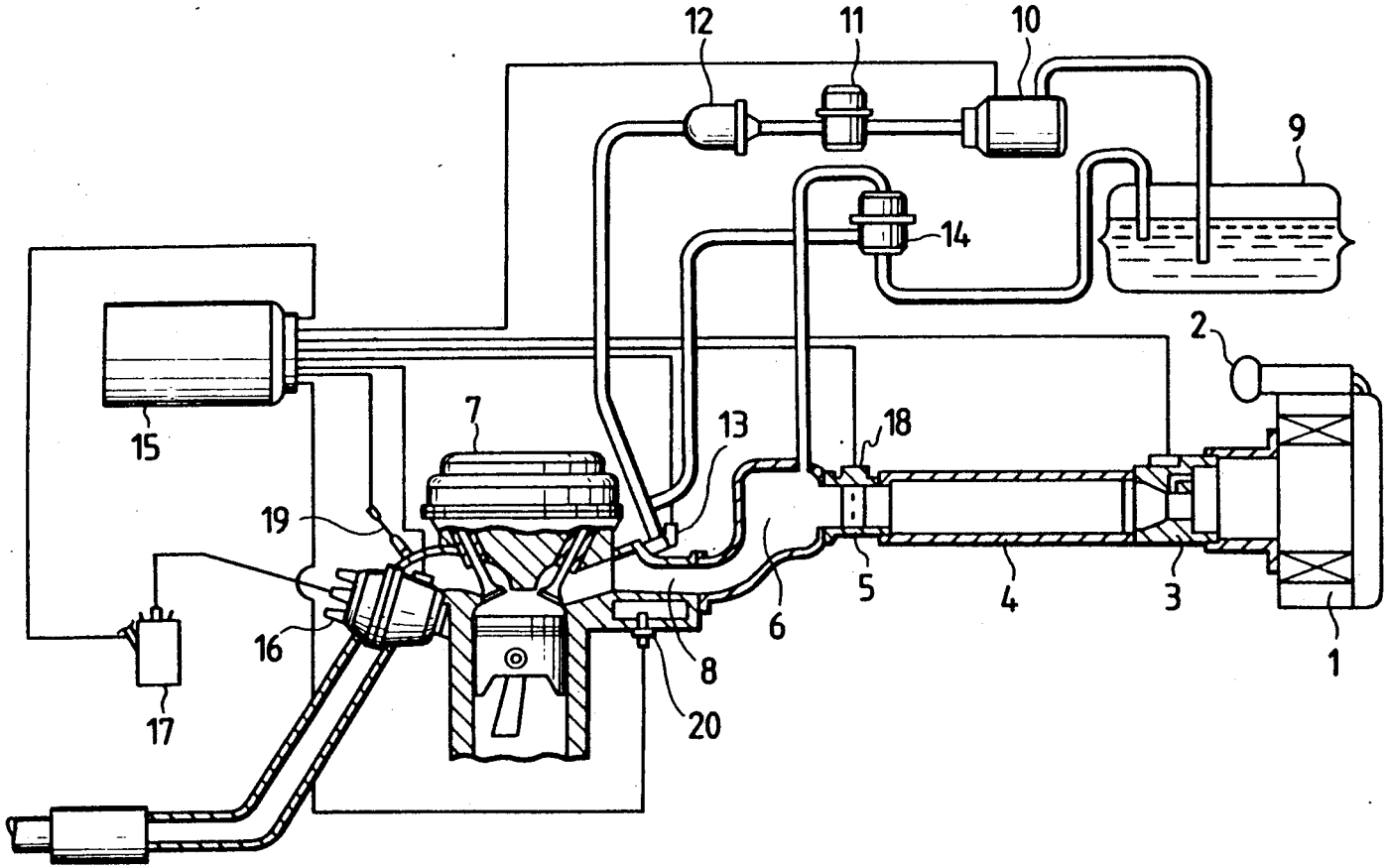
FIG. 11 is a constructional view showing an automatic engine control system structure of controlling an air-fuel ratio of one embodiment in an apparatus of controlling an air-fuel ratio for use in an internal combustion engine according to the present invention.

In FIG. 11, air from an inlet portion 2 of an air cleaner 1 enters into a collector 6 via the hot wire type air flow meter 3 for detecting an intake air flow amount $Q_a$, a duct 4, and a throttle valve body 5 having a throttle valve for controlling the intake air flow amount $Q_a$. In the collector 6, the air is distributed into each intake pipe 8 which communicates directly to the gasoline internal combustion engine 7 and inhaled into cylinders of the internal combustion engine 7.

Besides, fuel from a fuel tank 9 is sucked and pressurized by a fuel pump 10, and the fuel is supplied into a fuel supply system comprising a fuel damper 11, a fuel filter 12, the fuel injector 13, and a fuel pressure control regulator 14. The fuel is controlled at a predetermined pressure value by the fuel pressure control regulator 14 and injected into the respective intake pipe 8 through the fuel injector 13 being disposed on the intake pipe 8.

Further, a signal for detecting the intake air flow amount $Q_a$ is outputted from the air flow meter 3. This output signal from the air flow meter 3 is inputted into the electronic control unit 15. A throttle valve sensor 18 for detecting an opening degree $\theta_{th}$ of the throttle valve is installed to the throttle valve body 5. The throttle valve sensor 18 works as a throttle valve opening degree detecting sensor and also as an idle switch. An output signal from the throttle valve sensor 18 is inputted into the electronic control unit 15.

A cooling water temperature detecting sensor 20 for detecting a cooling water temperature of the internal combustion engine 7 is installed to a main body of the internal combustion engine 7. An output signal from the cooling water temperature detecting sensor 20 is inputted into the electronic control unit 15.

In a distributor 16, a crank angle detecting sensor is installed therein. The crank angle detecting sensor outputs a signal for detecting a fuel injection time, an ignition time, a standard signal, and the engine speed N. An output signal from the crank angle detecting sensor is inputted into the electronic control unit 15. An ignition coil 17 is connected to the distributor 16.

Figure 12:
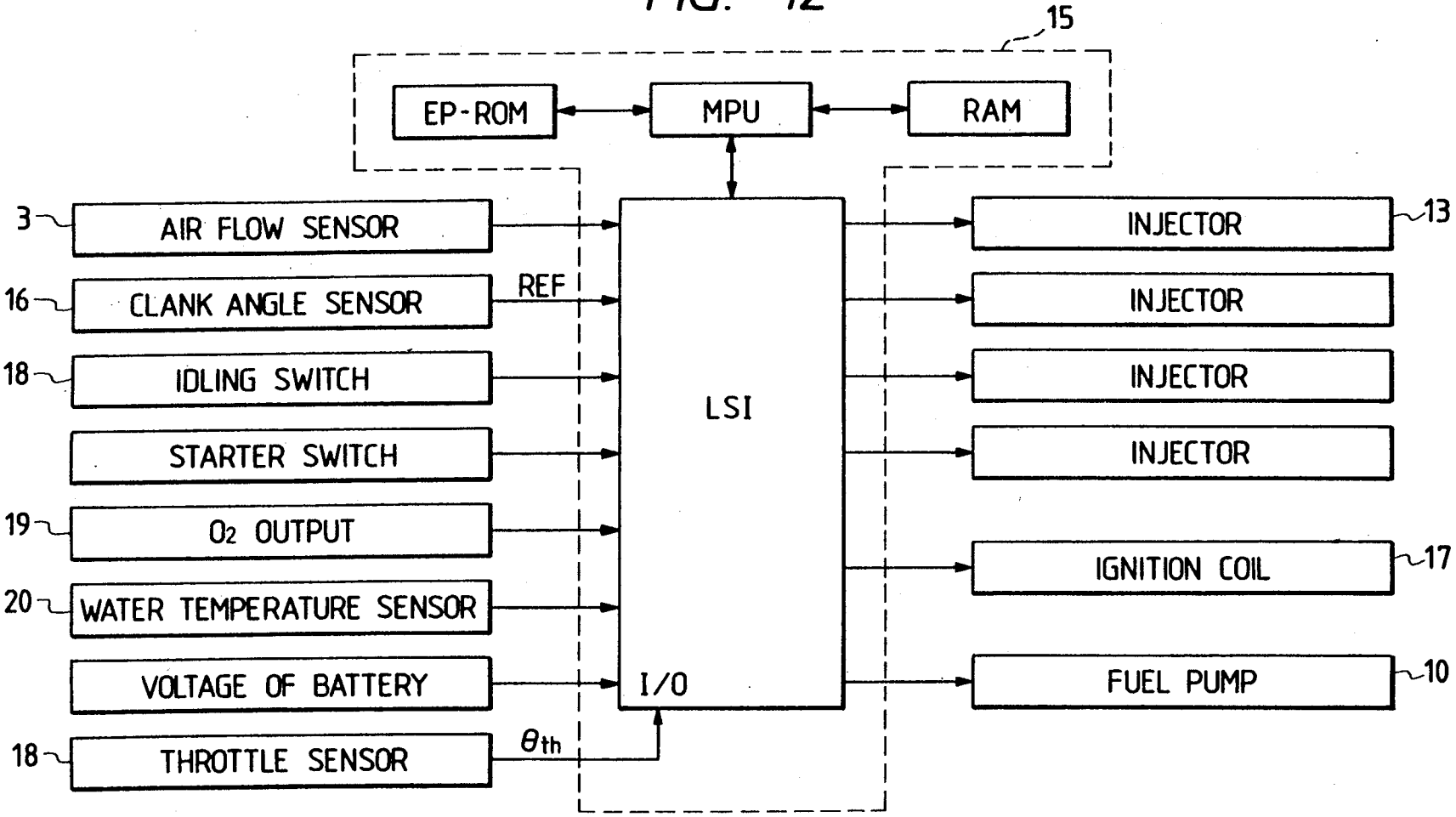
FIG. 12 is a block diagram showing an automatic engine control system structure of controlling an air-fuel ratio of one embodiment in an electronic control unit and related apparatuses thereof shown in FIG. 11 according to the present invention.

The electronic control unit 15 comprises an execution apparatus including MPU, EP-ROM, RAM, A/D convertor and input circuits as shown in FIG. 12. In the electronic control unit 15, a predetermined execution is carried out through the output signal from the air flow meter 3, the output signal from the distributor 16 etc. The fuel injector 13 is operated by output signals obtained by the execution results in the electronic control unit 15, then the necessary amount fuel is injected into respective intake pipe 8.

We claim:

1. A method of controlling an air-fuel ratio for use in an internal combustion engine in which a fuel injection amount to be supplied into an internal combustion engine is determined in accordance with parameters indicating an operational condition of the internal combustion engine, said method comprising the steps of:

calculating an air-fuel ratio in accordance with a physical amount of an exhaust gas;

dividing a deviation to a target value of the air-fuel ratio at a predetermined rate in accordance with the parameters indicating the operational condition of the internal combustion engine;

learning a respective divided deviation as a respective distinct element for the parameters indicating the operational condition of the internal combustion engine;

memorizing said respective divided deviation in one of a plurality of memory areas;

repeatedly carrying out a calculation for calculating said deviation to the target value of the air-fuel ratio and a division for dividing said deviation in accordance with the parameters indicating the operational condition of the internal combustion engine; and updating a value being memorized in one of said plurality of memory areas at each time said calculation and division is repeated by learning using a value of said divided deviation;

wherein said calculation for said deviation to update said memory value according to the learning is carried out by multiplying said calculated deviation value of the air-fuel ratio to the target air-fuel ratio by a predetermined function.

2. A method of controlling an air-fuel ratio for use in an internal combustion engine in which a fuel injection amount to be supplied into an internal combustion engine is determined in accordance with parameters indicating an operational condition of the internal combustion engine, said method comprising the steps of:

calculating an air-fuel ratio in accordance with a physical amount of an exhaust gas;

dividing a deviation to a target value of the air-fuel ratio at a predetermined rate in accordance with the parameters indicating the operational condition of the internal combustion engine;

learning a respective divided deviation as a respective distinct element for the parameters indicating the operational condition of the internal combustion engine;

memorizing said respective divided deviation in one of a plurality of memory areas;

repeatedly carrying out a calculation for calculating said deviation to the target value of the air-fuel ratio and a division for dividing said deviation in accordance with the parameters indicating the operational condition of the internal combustion engine; and updating a value being memorized in one of said plurality of memory areas at each time said calculation and division is repeated by learning using a value of said divided deviation;

wherein at a first time occurrence of the learning step, said divided deviation is memorized in at least two memory areas provided in correspondence to the parameters indicating the operational condition of the internal combustion engine, and said divided deviation is requested by multiplying said calculated deviation value of the air-fuel ratio by a predetermined function.

3. A method of controlling an air-fuel ratio for use in an internal combustion engine according to claim 2, wherein a value of the predetermined function at a first time of occurrence of said learning step is set larger than a value of the predetermined function at a succeeding learning step.

4. A method of controlling an air-fuel ratio for use in an internal combustion engine in which a fuel injection amount to be supplied into an internal combustion engine is determined in accordance with at least one of a fuel injection amount and a physical amount in proportion to said fuel injection amount and at least one of an intake air flow amount and a physical amount in proportion to said intake air flow amount, said method comprising the steps of:

calculating an air-fuel ratio in accordance with a physical amount of an exhaust gas;

dividing a deviation to a target value of the air-fuel ratio at a predetermined rate in accordance with said at least one of said fuel injection amount and said physical amount in proportion to said fuel injection amount and at least one of said intake air flow amount and said physical amount in proportion to said intake air flow amount;

learning a respective divided deviation as a respective distinct element for said at least one of said fuel injection amount and said physical amount in proportion to said fuel injection amount and said at least one of said intake air flow amount and said physical amount in proportion to said intake air flow amount;

memorizing said respective divided deviation in one of a plurality memory areas;

repeatedly carrying out a calculation for calculating said deviation to the target value of the air-fuel ratio and a division for dividing of said deviation in accordance with said at least one of said fuel injection amount and said physical amount in proportion to said fuel injection amount and said at least one of said intake air flow amount and said physical amount in proportion to take intake air flow amount; and updating a value being memorized in one of said plurality of memory areas each time said calculation and division is repeated by learning using a value of said divided deviation;

wherein said calculation for said deviation to update said memory value according to the learning is carried out by multiplying said calculated deviation value of the air-fuel ratio to the target air-fuel ratio by a predetermined function.

5. A method of controlling an air-fuel ratio for use in an internal combustion engine in which a fuel injection amount to be supplied into an internal combustion engine is determined in accordance with at least one of a fuel injection amount and a physical amount in proportion to said fuel injection amount and at least one of an intake air flow amount and a physical amount in proportion to said intake air flow amount, said method comprising the steps of:

calculating in accordance with a physical amount of an exhaust gas;

dividing a deviation to a target value of the air-fuel ratio at a predetermined rate in accordance with said at least one of said fuel injection amount and said physical amount in proportion to said fuel injection amount and said at least one of said intake air flow amount and said physical amount in proportion to said intake air flow amount;

learning a respective divided deviation as a respective distinct element for said at least one of said fuel injection amount and said physical amount in proportion to said fuel injection amount and said at least one of said intake air flow amount and said physical amount in proportion to said intake air flow amount;

memorizing said respective divided deviation in one of a plurality memory areas;

repeatedly carrying out a calculation for calculating said deviation to the target value of the air-fuel ratio and a deviation in accordance with said at least one of said fuel injection amount and said physical amount in proportion to said fuel injection amount and said at least one of said intake air flow amount and said physical amount in proportion to said intake air flow amount; and updating a value being memorized in one of said plurality of memory areas each time said calculation and division is repeated by learning using a value of said divided deviation;

wherein at a first time of occurrence of said learning step, said divided deviation is memorized in at least two memory areas provided in correspondence to said at least one of said fuel injection amount and said physical amount in proportion to said fuel injection amount and said at least one of said intake air flow amount and said physical amount in proportion to said intake air flow amount, and said divided deviation is requested by multiplying said calculated deviation value of the air-fuel ratio by a predetermined function.

6. A method of controlling an air-fuel ratio for use in an internal combustion engine in which a fuel injection amount to be supplied into an internal combustion engine is determined in accordance with at least one of a fuel injection amount and a physical amount in proportion to said fuel injection amount and at least one of an intake air flow amount and a physical amount in proportion to said intake air flow amount, said method comprising the steps of:

calculating an air-fuel ratio in accordance with a physical amount of an exhaust gas;

dividing a deviation to a target value of the air-fuel ratio at a predetermined rate in accordance with said at least one of said fuel injection amount and said physical amount in proportion to said fuel injection amount and said at least one of said intake air flow amount and said physical amount in proportion to said intake air flow amount;

learning a respective divided deviation as a respective distinct element for said at least one of said fuel injection amount and said physical amount in proportion to said fuel injection amount and said at least one of said intake air flow amount and said physical amount in proportion to said intake air flow amount;

memorizing said respective divided deviation in one of a plurality memory areas;

repeatedly carrying out a calculation for calculating said deviation to the target value of the air-fuel ratio and a division for dividing said deviation in accordance with said at least one of said fuel injection amount and said physical amount in proportion to said fuel injection amount and said at least one of said intake air flow amount and said physical amount in proportion to said intake air flow amount; and updating a value being memorized in one of said plurality of memory areas each time said calculation and division is repeated by learning using a value of said divided deviation;

wherein a value of the predetermined function at a first time of occurrence of said learning step is set larger than a value of the predetermined function at a succeeding learning step.

7. A method of controlling an air-fuel ratio for use in an internal combustion engine in which a fuel injection amount to be supplied into an internal combustion engine is determined in accordance with at least one of a fuel injection amount and a physical amount in proportion to said fuel injection amount and at least one of an intake air flow amount and a physical amount in proportion to said intake air flow amount, said method comprising the steps of:

calculating an air-fuel ratio in accordance with a physical amount of an exhaust gas;

dividing a deviation to a target value of the air-fuel ratio at a predetermined rate in accordance with said at least one of said fuel injection amount and said physical amount in proportion to said fuel injection amount and said at least one of said intake air flow amount and said physical amount in proportion to said intake air flow amount;

learning a respective divided deviation as a respective distinct element for said at least one of said fuel injection amount and said physical amount in proportion to said fuel injection amount and said at least one of said intake air flow amount and said physical amount in proportion to said intake air flow amount;

memorizing said respective divided deviation in one or a plurality memory areas;

repeatedly carrying out a calculation for calculating said deviation to the target value of the air-fuel ratio and a division for dividing said deviation in accordance with said at least one of said fuel injection amount and said physical amount in proportion to said fuel injection amount and said at least one of said intake air flow amount and said physical amount in proportion to said intake air flow amount; and updating a value being memorized in one of said plurality of memory areas each time said calculation and division is repeated by learning using a value of said divided deviation;

wherein the air-fuel ratio is corrected by using a learning value being searched by values of said at least one of said fuel injection amount and said physical amount in proportion to said fuel injection amount and said at least one of said intake air flow amount and said physical amount in proportion to said intake air flow amount;

wherein a value of the predetermined function at a first time of occurrence of said learning step is set larger than a value of the predetermined function at a succeeding learning step.

8. An apparatus for controlling an air-fuel ratio for use in an internal combustion engine comprising:

first execution means for calculating a fuel injection amount in accordance with parameters indicating an operational condition of an internal combustion engine;

second execution means for calculating an air-fuel ratio in accordance with a physical amount of an exhaust gas;

comparison execution means for calculating a deviation by comparing a target value of an air-fuel ratio to said calculated value of the air-fuel ratio obtained by said second execution means;

third execution means for dividing said calculated deviation obtained by said comparison execution means in accordance with the parameters indicating the operational condition of the internal combustion engine;

fourth execution means for learning said calculated divided deviation obtained by said comparison execution means as a respective distinct element and for correcting the air-fuel ratio;

memory means for memorizing said calculated divided deviation obtained by said comparison execution means and having a plurality of memory areas corresponding to the parameters indicating the operational condition of the internal combustion engine;

multiply means for dividing said calculated deviation by multiplying said calculated deviation value of the air-fuel ratio obtained by said second execution means by a predetermined function; and learning execution means for updating a value being memorized in a memory area in accordance with said deviation value divided by said multiply means.

9. An apparatus for controlling an air-fuel ratio for use in an internal combustion engine comprising:

first execution means for calculating a fuel injection amount in accordance with at least one of a fuel injection amount and a physical amount in proportion to said fuel injection amount and at least one of an intake air flow amount and a physical amount in proportion to said intake air flow amount;

second execution means for calculating an air-fuel ratio in accordance with a physical amount of an exhaust gas;

comparison execution means for calculating a deviation by comparing a target value of an air-fuel ratio to said calculated value of the air-fuel ratio obtained by said second execution means;

third execution means for dividing said calculated deviation obtained by said comparison execution means in accordance with said at least one of said fuel injection amount and said physical amount in proportion to said fuel injection amount and said at least one of said intake air flow amount and said physical amount in proportion to said intake air flow amount;

fourth execution means for learning said calculated divided deviation obtained by said comparison execution means as a respective distinct element and for correcting the air-fuel ratio;

memory means for memorizing said calculated divided deviation obtained by said comparison execution means and having a plurality of memory areas corresponding to said at least one of said fuel injection amount and said physical amount in proportion to said fuel injection amount and said at least one of said intake air flow amount and said physical amount in proportion to said intake air flow amount;

multiplying means for dividing said calculated divided deviation by multiplying said calculated deviation value of the air-fuel ratio obtained by said second execution means by a predetermined function; and learning execution means for updating a value being memorized in a memory area in accordance with said deviation value divided by said multiply means.

* * * * *